United States Patent [19]

Lewicki et al.

[11] 4,044,400

[45] Aug. 30, 1977

[54] HELMET RETENTION SYSTEM

[75] Inventors: Lester R. Lewicki, Woodland Hills; James D. Santacroce, Beverly Hills, both of Calif.

[73] Assignee: Bell Helmets Inc., Norwalk, Calif.

[21] Appl. No.: 733,139

[22] Filed: Oct. 18, 1976

[51] Int. Cl.[2] ..... A42B 7/00

[52] U.S. Cl. ..... 2/421

[58] Field of Search ..... 2/421, 5, 6, 425, 410–420

[56] References Cited

U.S. PATENT DOCUMENTS

| | | | |
|---|---|---|---|
| 2,769,176 | 11/1956 | Grancsay et al. | 2/421 |
| 2,846,683 | 8/1958 | Dye et al. | 2/421 |
| 2,991,478 | 7/1961 | Zbikowski | 2/421 |
| 3,082,428 | 3/1963 | Zbikowski | 2/418 |
| 3,310,811 | 3/1967 | Iacono | 2/6 |
| 3,783,450 | 1/1974 | O'Connor | 2/425 X |
| 3,873,997 | 4/1975 | Gooding | 2/416 X |

FOREIGN PATENT DOCUMENTS

| | | | |
|---|---|---|---|
| 32,355 | 10/1964 | Germany | 2/419 |

*Primary Examiner*—Alfred R. Guest

*Attorney, Agent, or Firm*—White and Haefliger

[57] ABSTRACT

A helmet retention system including a forwardly facing helmet comprises, a. left and right side retention strap sections, the left section having attachments to the helmet at forward and rearward locations, and the right section having attachments to the helmet at forward and rearward locations, the sections hanging from the helmet, b. left and right sliders respectively slidably attached to the left and right retention straps to be adjustably slidable therealong, and c. chin strap means having attachment to and hanging from the sliders to extend therebetween.

12 Claims, 13 Drawing Figures

HELMET RETENTION SYSTEM

BACKGROUND OF THE INVENTION

This invention relates generally to adjustable retention of helmets, as for example are used by bicycle or motorcycle riders; more particularly, it concerns a very simple retention system employing few parts and providing for universal adjustment of the helmet on the wearer's head. The invention is especially adapted for use with lightweight, plastic helmets as will be described.

SUMMARY OF THE INVENTION

It is a major object of the invention to provide an unusually advantageous helmet retention system that basically comprises:

a. left and right side retention strap sections, the left section having attachments to the helmet at forward and rearward locations, and the right section having attachments to the helmet at forward and rearward locations, the sections hanging from the helmet, b. left and right sliders respectively slidably attached to the left and right retention straps to be adjustably slidable therealong, and c. chin strap means having attachment to and hanging from the sliders to extend therebetween.

As will appear, the sliders may comprise like plates containing forward and rearward slits for passing the left and right retention strap sections, and vertically spaced horizontal slits to pass looping portions of the chin strap sections; the left and right retention strap sections may comprise a single strap attached to the rear of the helmet via angled slits in the helmet, and adjustably attached to the left and right sides of the helmet via additional slits. Further, the chin strap means typically includes primary and secondary sections adjustably interconnected via D-rings as will be described, the sliders supporting those sections.

As a result, the sliders may be adjustably shifted along the left and right retention strap sections to control forward or rearward tilting of the helmet; the closeness of the sliders to the wearer's ear may be adjusted by adjusting the attachments of the retention strap sections to the helmet; and the tightness of the chiin strap means may also be adjusted.

These and other objects and advantages of the invention, as well as the details of an illustrative embodiment, will be more fully understood from the following description and drawings, in which:

DRAWING DESCRIPTION

Figure 1:
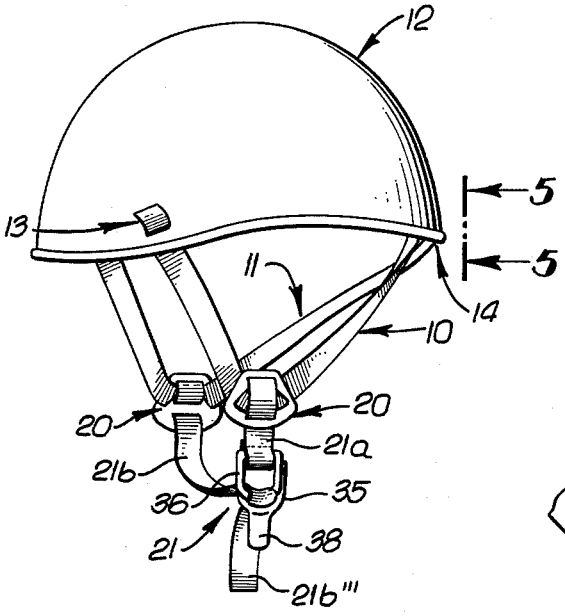
FIG. 1 is a side elevation of a helmet and retention system.
Figure 3:
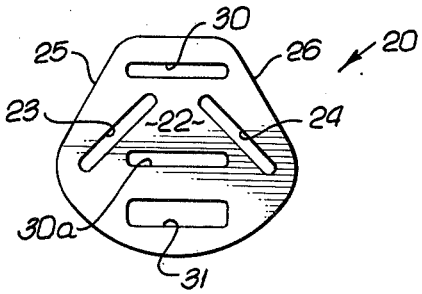
Figure 4:
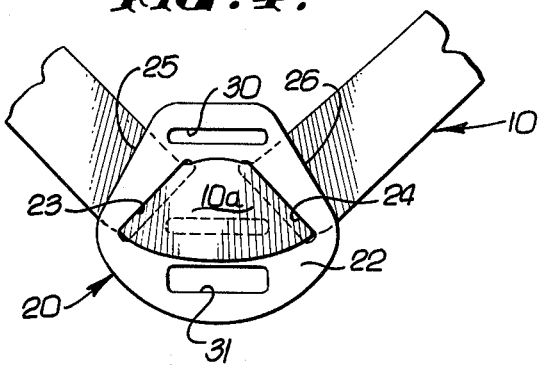
Figure 2:
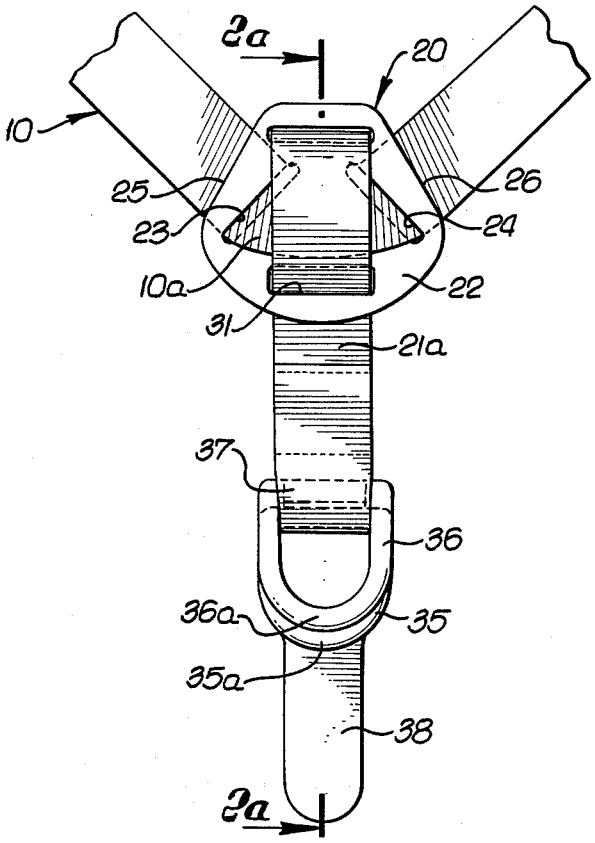
FIG. 2 is an enlarged side elevation of a slider and associated strap.
Figure 2A:
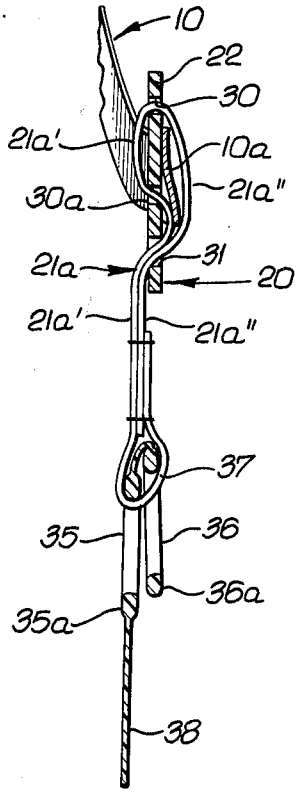
Figure 5:
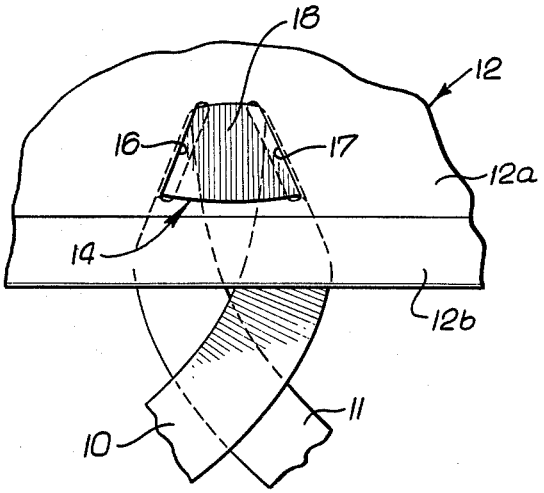
Figure 6:
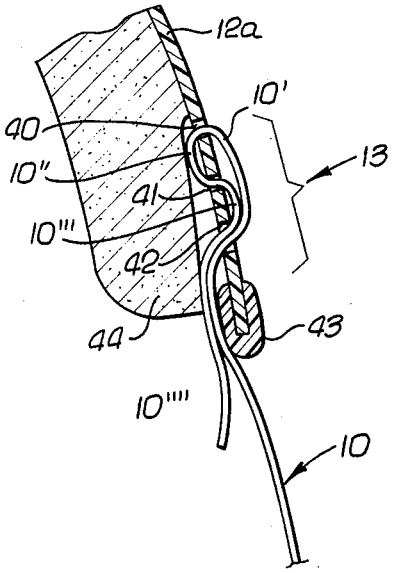
Figure 7:
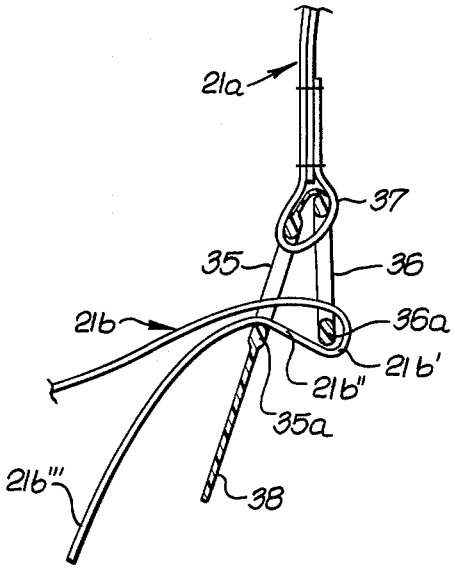
Figure 8:
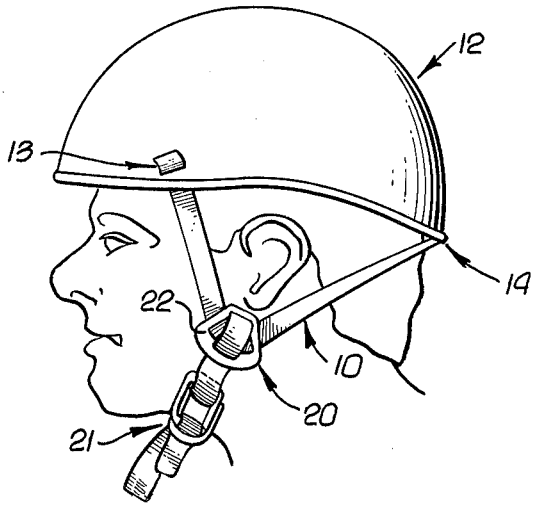

FIG. 2*a* is a vertical section on lines 2*a*—2*a* of FIG. 2;

FIG. 3 is a side elevation of the slider seen in FIG. 2;

FIG. 4 is a view like FIG. 3 showing a retention strap section passing through slits in the slider;

FIG. 5 is an elevation on lines 5—5 of FIG. 1, showing anchorage of the retention strap to a rear portion of the helmet;

FIG. 6 is an enlarged vertical section through a side portion of the helmet, and looking rearwardly, to illustrate left retention strap section attachment to the helmet;

FIG. 7 is a vertical elevation showing chin strap sections in relation to D-rings; and FIGS. 8–12 are side elevations showing different positions of the helmet on the wearer's head.

DETAILED DESCRIPTION

Figure 9:
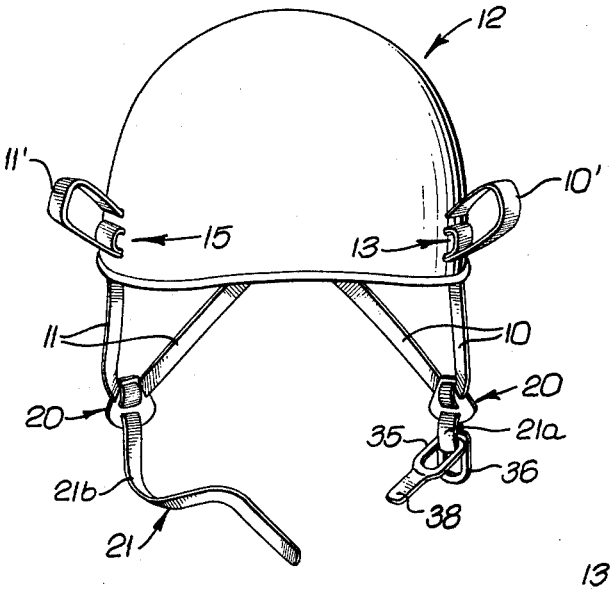
Figure 10:
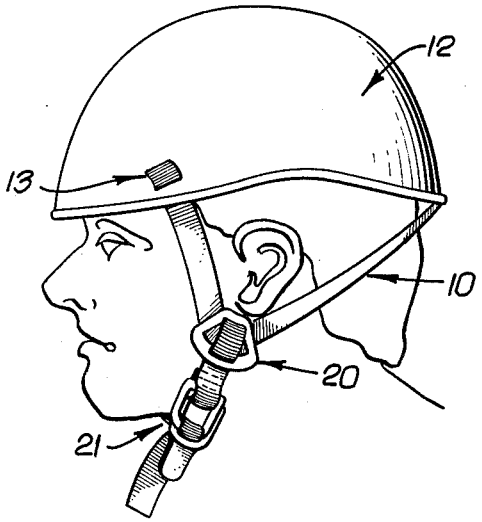

In FIGS. 1, 5 and 9 the system shown includes left and right retention strap sections 10 and 11, the left sections having attachments to the helmet 12 at forward and rearward locations 13 and 14, and the right section having attachments to the helmet at forward and rearward locations 15 and 14. Note that the sections both hang from the helmet, the forward locations 13 and 15 being located about ¼ to ⅓ of the way from the front to the rear, and that the rearward locations 14 are common or near one another. The sections 10 and 11 may consist of one continuous strap passing through upwardly tapering slits 16 and 17 in the rearwardmost portion of the helmet shell 12*a*. The sections merge at 18 at the outer side of the shell, whereby they pass downwardly at the inner side of the shell 12*a* rim bead 12*b*, as is clear from FIG. 5, and cross below the bead.

Left and right sliders, as at 20, are respectively slidably attached to the left and right retention straps to be adjustably slidable therealong; in addition, chin strap means, generally indicated at 21, has attachment to the sliders and hangs therefrom as seen in FIG. 1. Each slider may, with unusual advantage, take the form of a plate containing forward and rearward slits for passing a retention strap section. As seen in FIGS. 2–4, the upright plate 22 contains forward and rearward slit 23 and 24 which are upwardly convergent, for directing the left retention strap sections in V-shape configuration beyond the slider edges 25 and 26, as shown. Note that section 10 extends at 10*a* at the outer side of the plate. Each slider plate also contains upper, middle and lower generally horizontal slits 30, 30*a* and 31 for passing a looping portion of the chin strap means. In FIGS. 2, 2*a* and 7, the left section 21*a* of the chin strap means extends upwardly, and outwardly through lower slit 31 as two overlapping portions 21*a*′ and 21*a*″; portion 21*a*′ extends back through slit 30*a* and then upwardly and through upper slit 30 to merge with portion 21*a*″ at the outer side of the slider. The portion 21*a*″ overlaps portion 10*a* of section 10, at the outer side of the plate, as seen in FIG. 2*a*, tending to frictionally hold the portion 10*a* clamped against the plate, during usage. The edges of slits 23 and 24 also tend to position the slider lengthwise of the retention strap 10. The other section 21*b* of the chin strap means may be similarly retained by the slider associated with retention strap 11.

Referring to FIGS. 2 and 7, two D-rings 35 and 36 are provided and suspended by a looping portion 37 of the chin strap means. Portion 37 may be integral with section 21*a*, as described above. The secondary section 21*b* of the chin strap means laces through the first ring 35 and then through the second ring 36; it then loops about the outer side of a lateral leg 36*a* of ring 36, at locus 21*b*′, and then extends at 21*b*″ back through the first D-ring 35 adjacent and at the inner side of its lateral leg 35*a*. When chin strap end 21*b*‴ is pulled tight, the chin strap tightens against the wearer's chin or jaw, and the strap 21*b* is retained by the clamping action of the D-rings. A pull-tab 38 integral with ring 35 may be pulled to the right in FIG. 7 to loosen the chin strap means.

Referring now to FIG. 6, the forward attachment at 13 and 15 advantageously include vertically spaced perforations in the left and right side of the typically plastic helmet, and through which the left and right retention strap sections extend, respectively. FIG. 6 which looks rearwardly at the left retention strap section attachment, illustrates the provision of three vertically spaced, horizontally extending, perforations 40, 41 and 42 through the helmet shell 12*a*. The left retention strap section 10 extends upwardly into the shell between bead 43 and inner cushion 44, then outwardly through lower slit 42, then upwardly at 10' to enter inwardly via slit 40 into the helmet, then downwardly at 10'' between the shell and cushion 44, then back outwardly through middle slit 41, then downwardly at 10''', and then back inwardly through lower slit 42 to terminate at 10''''. Accordingly, a looping configuration is formed, which is loosenable and adjustable to adjust the chin strap means. Thus, to raise the adjusting plates, the strap extent 10' is pulled outwardly to enlarge the loop as seen in FIG. 9 and inner strap extent 10'''' is pulled downwardly; this procedure is carried out at both attachment locations 13 and 15 using both straps 10 and 11. Reversal of this procedure lowers the plates and the chin strap. The plates 22 should fit just below the ears as in FIG. 8.

Figure 11:
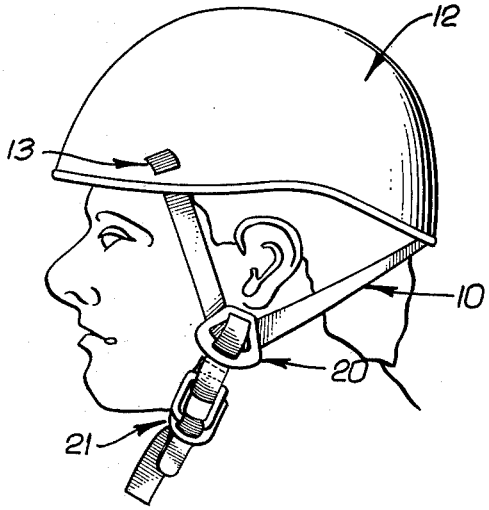
Figure 12:
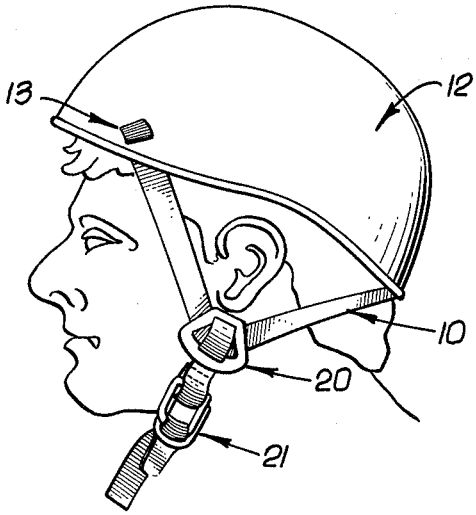

The helmet 10 should sit level on the wearer's head, as in FIG. 11. If the helmet is tilted too far down in front, as in FIG. 10, obstructing vision, the sliders 20 are moved rearwardly on the straps 10 and 11. If the helmet is tilted too far to the rear as in FIG. 12, the sliders may be moved forwardly on straps 10 and 11 until the helmet seats poorly as in FIG. 11.

Note that very simple construction and unusual adjustment of the helmet is provided for, as enabled by the sliders and their relationship to the retention and chin straps, and by adjustment of the straps as described.

Merely as illustrative, the outer helmet 12*a* may consist of LEXAN, and the inner cushion 44 of polystyrene.

We claim:

1. In a helmet retention system including a forwardly facing helmet, a. left and right side retention strap sections, the left section having attachments to the helmet at forward and rearward locations, and the right section having attachments to the helmet at forward and rearward locations, the sections hanging from the helmet, b. left and right sliders respectively slidably attached to the left and right retention straps to be adjustably slidable therealong, and c. chin strap means having attachment to and hanging from the sliders to extend therebetween.

2. The system of claim 1 wherein each slider is defined by a plate containing forward and rearward slits passing a retention strap section therethrough.

3. The system of claim 2 wherein each slider plate extends in an upright plane, and said slits converge upwardly.

4. The system of claim 2 wherein each slider plate extends in an upright plane and contains upper, middle and lower generally horizontal slits passing a looping portion of the chin strap means.

5. The system of claim 4 wherein said retention strap sections comprise a single retention strap passing through the forward and rearward slits of each slider, and said rearward location being proximate the rearwardmost portion of the helmet.

6. The system of claim 4 wherein the chin strap means includes primary and secondary sections passing in looping configuration through the upper, middle and lower slits of the two sliders, respectively.

7. The system of claim 6 wherein at the outer side of the slider both a chin strap section and a retention strap section extend in mutually overlapping configuration.

8. The system of claim 6 including first and second D-rings to both of which the primary section of the chin strap means has looping attachment.

9. The system of claim 8 wherein the secondary section of the chin strap means laces through the first and then through the second D-ring, then loops about the outer side of a lateral leg of the second ring, and then extends back through the first D-ring adjacent and at the inner side of a lateral leg of the first D-ring.

10. The system of claim 9 including a pull-tab attached to and projecting from the first D-ring.

11. The system of claim 1 wherein said forward attachments include vertically spaced perforations in the left side of the helmet and in the right side of the helmet and through which the left and right retention strap sections extend, respectively.

12. The system of claim 6 wherein three vertically spaced perforations are defined at the left side of the helmet to receive the left retention strap sections in adjustable looping configuration, and three vertically spaced perforations are defined at the right side of the helmet to receive the right retention strap section in adjustable looping configuration.

* * * * *